United States Patent [19]

Bennett

[11] 4,385,745

[45] May 31, 1983

[54] REBAR-CONNECTED SUPPORT MEANS FOR CONCRETE FORM PANELS

[75] Inventor: Steven B. Bennett, Congress, Ariz.

[73] Assignee: The Burke Company, San Mateo, Calif.

[21] Appl. No.: 258,659

[22] Filed: Apr. 29, 1981

[51] Int. Cl.[3] ..... E04G 17/06

[52] U.S. Cl. ..... 249/41; 52/726; 52/733; 249/214

[58] Field of Search ..... 52/733, 726; 249/214, 249/41

[56] References Cited

U.S. PATENT DOCUMENTS

| | | | |
|---|---|---|---|
| 857,973 | 6/1907 | Aus | 52/733 |
| 1,202,336 | 10/1916 | Varney | 52/733 |
| 1,202,359 | 10/1916 | Braumuller | 52/733 |
| 1,213,228 | 1/1917 | Matsinger | 52/726 |
| 1,586,991 | 6/1926 | Hawley | 249/41 |
| 2,057,732 | 10/1936 | Navarre | 249/41 |
| 2,750,648 | 6/1956 | Hallock | 249/41 |
| 3,260,495 | 7/1966 | Buyken | 249/41 |
| 3,263,958 | 8/1966 | Cox et al. | 249/41 |
| 3,881,684 | 5/1975 | Daniels | 249/214 |
| 4,125,245 | 11/1978 | Seidl | 249/214 |

FOREIGN PATENT DOCUMENTS

| | | | |
|---|---|---|---|
| 213029 | 1/1961 | Austria | 52/733 |

OTHER PUBLICATIONS

The Burke Company "Snap Ties", p. 19.

*Primary Examiner*—John C. Bleutge
*Assistant Examiner*—A. H. Koeckert
*Attorney, Agent, or Firm*—Naylor, Neal & Tilkema

[57] ABSTRACT

Concrete form panels are connected by snap ties to rebars and thereby supported by the rebars. Adaptor plates enable the connection of the snap ties to the rebars.

3 Claims, 12 Drawing Figures

REBAR-CONNECTED SUPPORT MEANS FOR CONCRETE FORM PANELS

BACKGROUND OF THE INVENTION

The invention pertains to support means for concrete form panels, and more particularly to a combination of means whereby snap ties may be connected to rebars for the support of form panel assemblages to which the snap ties are connected.

SUMMARY OF THE INVENTION

The primary object of the invention is to utilize snap ties as part of a rebar-connected support system for form panels.

The attainment of this object is accomplished through the provision of an adaptor or connector plate which serves to connect parallel, axially offset snap tie and rebar elements.

DESCRIPTION OF THE INVENTION

Figure 1:
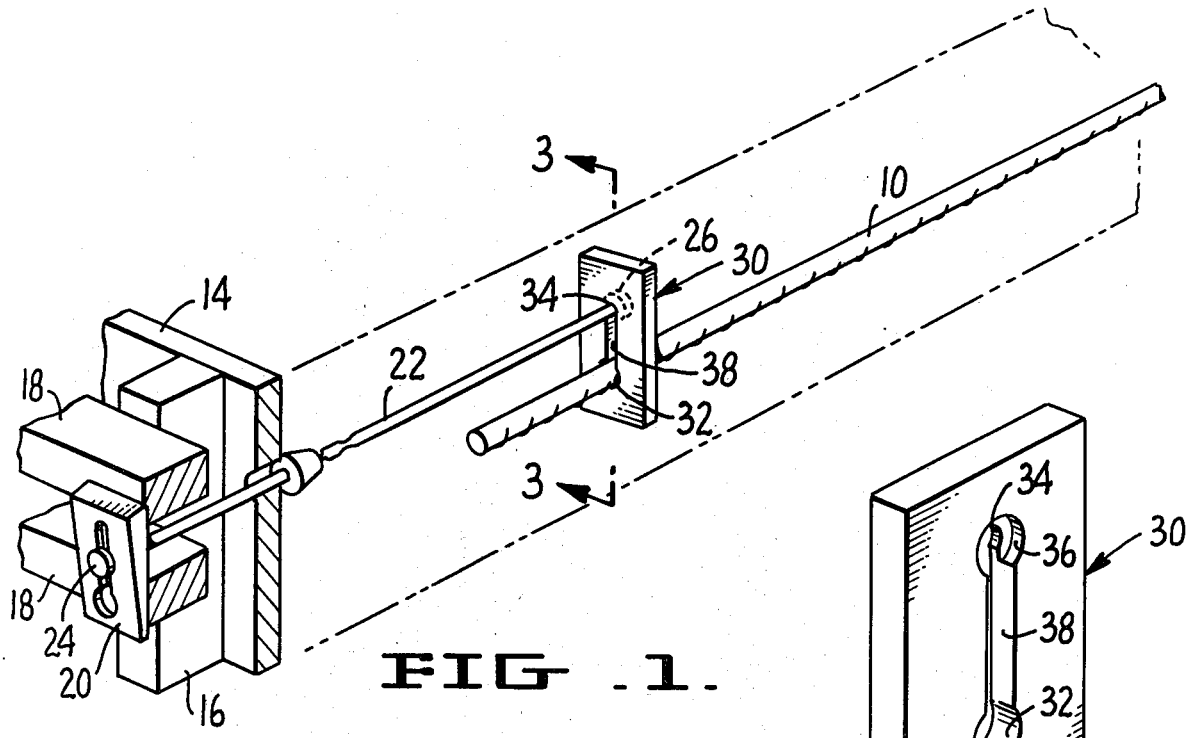
FIG. 1 is a view in perspective of a preferred embodiment of the invention.
Figure 5:
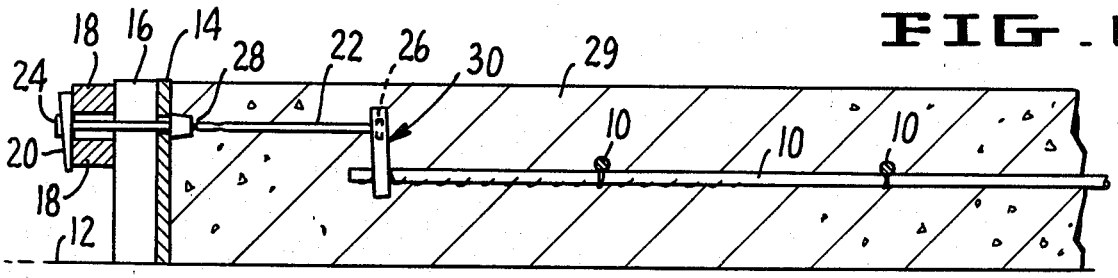
FIG. 5 is a view in side elevation of the embodiment of FIG. 1 after the pouring and setting of concrete.

Referring to FIGS. 1 and 5, a grid-work of rebars 10 is supported above ground level 12 by any suitable support means, such as pedestals, not shown. In spaced, surrounding relation to the rebar grid-work 10 is a form panel enclosure comprising form panels 14 having strongbacks 16, walers 18, waler plates 20 and snap ties 22. The snap ties 22 comprise heads 24 and 26 and a reduced section at point 28 enabling the ties to be snapped in two by the wrench-turning of proximal head 24 after the distal head has been fixed by the setting of concrete 30.

The snap ties 22 and rebars 10 are interconnected by an adaptor plate 30 having a through passageway 32 for the rebar 10, a through passageway 34 for the stem of the snap tie 22, a recess 36 for the distal head 26 of the snap tie, and a slot 38 of a width corresponding to the diameter of passageway 34 interconnecting passageways 32 and 34.

The adaptor plates 30 are first connected to the snap ties 22 by passing the distal heads 26 of the snap ties through the passageways 32 and then moving the plates so that the snap ties pass along the slots 38 into the passageways 34. The plates are thereafter slid along the snap ties to extend the rebars through the passageways 32, the latter being slightly oversized in relation to the diameter of the rebars, and to position the distal heads 26 within the plate recesses 36. The subsequent tightening of the waler plates 20 places the snap ties 22 under tension and cocks the plates 30 slightly relative to the rebars 10 so that a clamping action is set up between the plates 30 and rebars 10.

It will be appreciated that a rectangular enclosure form for the concrete is made up of four panels 14 and that some or all of the rebars 10 in both directions in which they extend within the rebar grid-work are interconnected at both ends in the manner illustrated in FIG. 1, i.e. with the form panels 14 being supported through the snap ties 22 and adaptor plates 30 by the rebars 10.

Figure 2:
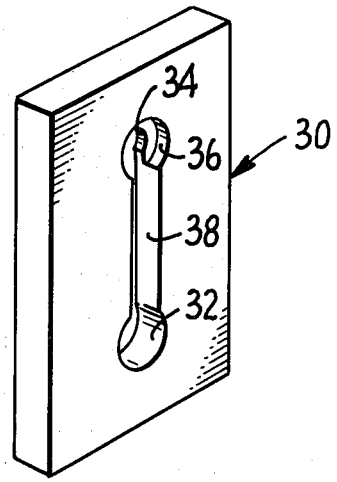
FIG. 2 is an enlarged view in perspective of the adaptor plate element of FIG. 1.
Figure 3:
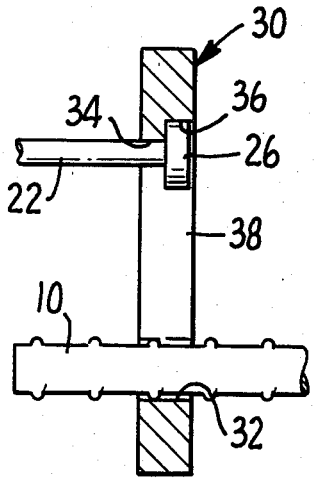
FIG. 3 is an enlarged view taken along lines 3—3 of FIG. 1.
Figure 4:
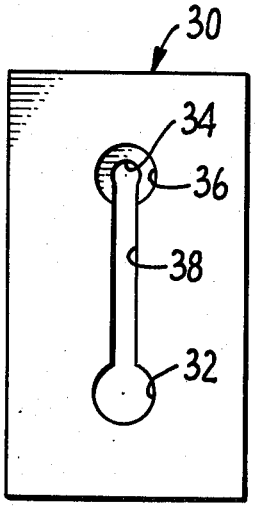
FIG. 4 is a view in front elevation of the adaptor plate of FIG. 2.
Figure 6:
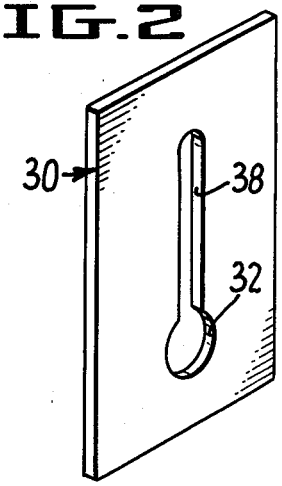
FIG. 6 is a view in perspective of a modification of the adaptor plate.

FIG. 6 illustrates a modified form of the adaptor plate. It has but a fraction of the thickness of the one shown in FIG. 2, and lacks the counter recess 36 for the distal head 26 of the snap tie. The inside surface of the latter merely engages the outside surface of the plate adjacent the upper end of slot 38.

Figure 7:
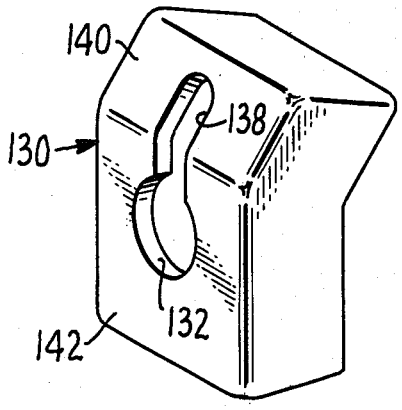
FIG. 7 is a view in perspective of another modification of the adaptor plate.
Figure 9:
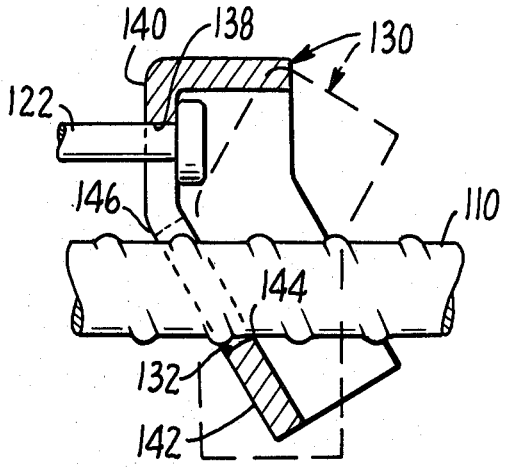
FIG. 9 is an enlarged view taken along lines 9—9 of FIG. 8.
Figure 8:
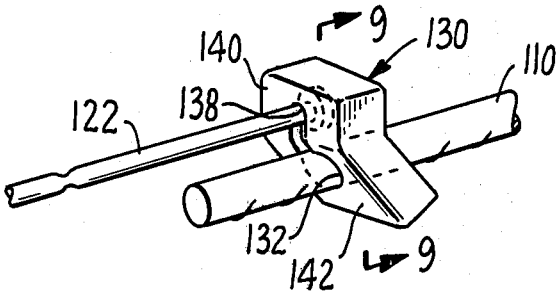
FIG. 8 is a view in perspective of the invention with the adaptor plate of FIG. 7.

In FIGS. 7–9, the adaptor plate is shown in the form of a four-sided plate having a front wall portion 140 containing the upper end of slot 138 and a lower front wall portion 142 containing the passageway 132 and the lower end of slot 138. When the elements are assembled, as in FIGS. 8–9, wall portion 140 is disposed normal to the stem of the snap tie 122 and wall portion 142 is disposed at an angle to rebar 110 such that slot edges 144 and 146 are disposed in biting engagement with the rebar.

Figure 10:
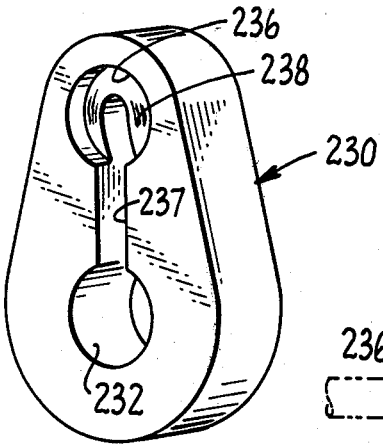
FIG. 10 is a view in perspective of another modification of the adaptor plate.
Figure 11:
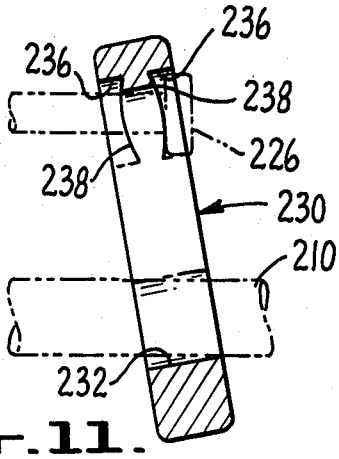
FIG. 11 is a view of the invention with the adaptor plate of FIG. 10, the adaptor plate being shown in section and the other elements being shown in dotted outline.

In FIGS. 10–11 the adaptor plate 230 is a ductile iron casting and provided with through passageway 232, slot 238 and opposed counter recesses 236 at the upper end of slot 238, the inner ends of the recesses 236 being in the shape of spherical surface segments 238. This results in simple linear engagement between the snap tie head 226 and the adjacent spherical surface segment 238. The snap tie thus applies a straight simple pulling action to the adaptor plate 230 to maximize the force couple applied by the edges of passageway 232 to rebar 210.

Figure 12:
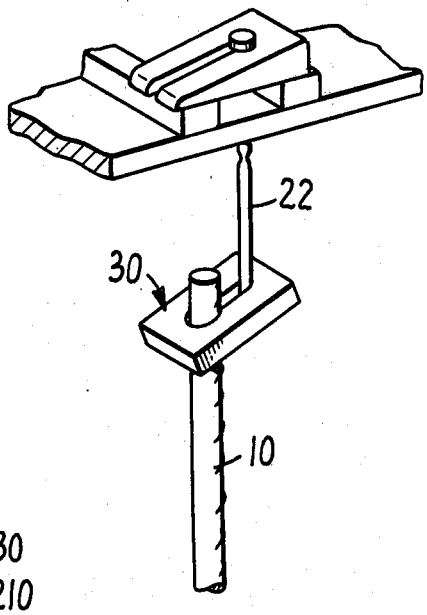
FIG. 12 is a view in perspective of the FIG. 1 embodiment of the invention vertically rather than horizontally oriented.

FIG. 12 shows the hardware of FIG. 1 oriented to dispose the snap ties 22 and rebars 10 vertically. The hardware will operate satisfactorily in any orientation in which it is disposed in space as long as the snap ties are tensioned to maintain the adaptor plates in biting or binding engagement with the rebars.

What is claimed is:

1. Concrete form panel support means comprising a snap tie having a shank portion and having a head portion at the distal end thereof, a connector plate having a keyhole passageway comprising an aperture portion of greater width and a slot portion of lesser width, said tie being received in said slot portion with the head portion engaged with the plate to the sides of the slot portion, and a rebar received in said aperture portion with the plate cocked relative to said rebar whereby the rebar is grippingly engaged by edge portions of the aperture portion, said aperture portion being greater in diameter than said head portion of said snap tie and said rebar to enable the passage through said plate of said head portion and the seating of said plate on said rebar, said slot portion being oversize in relation to said shank portion of said snap tie and undersize in relation to said head portion of said snap tie whereby said plate and said snap tie will have a one-way locking connection with each other when said shank portion is positioned within said slot portion and said head portion engages said plate.

2. The combination of claim 1, said shank portion being disposed away from said aperture portion at the remote end of said slot portion, said snap tie being under tension and having said one-way locking connection with said plate, said plate having opposed offset edges of said aperture portion disposed in gripping engagement with said rebar.

3. The combination comprising a rebar and means fixedly supporting said rebar, a plate having an aperture sleeved on said rebar, said plate being cocked relative to the rebar whereby the rebar is grippingly engaged by edge portions of the aperture, a snap tie received within a slot in said plate, said tie having a head engaged with the plate to the sides of the slot and being under tension to maintain said plate cocked into gripping engagement with said rebar, and a concrete form panel assemblage connected to said snap tie to maintain said snap tie under tension and to support said assemblage through the interconnected rebar, plate and snap tie elements.

* * * * *